US007351083B2

(12) United States Patent
Biddle et al.

(10) Patent No.: US 7,351,083 B2
(45) Date of Patent: Apr. 1, 2008

(54) ELECTRICAL CONNECTOR HAVING TERMINATING DEVICE

(75) Inventors: Gray E. Biddle, Carlisle, PA (US); Cesar Arroyo, Middletown, PA (US); Kuan-Yu Chen, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/481,608

(22) Filed: Jul. 5, 2006

(65) Prior Publication Data

US 2008/0009194 A1 Jan. 10, 2008

(51) Int. Cl.
*H01R 29/00* (2006.01)

(52) U.S. Cl. ..... 439/188; 439/620.18

(58) Field of Classification Search ..... 439/188, 439/620.17, 620.18, 620.23
See application file for complete search history.

(56) References Cited

U.S. PATENT DOCUMENTS

| | | | | |
|---|---|---|---|---|
| 4,717,217 | A * | 1/1988 | Bogese, II | 439/83 |
| 5,964,600 | A * | 10/1999 | Miles et al. | 439/140 |
| 6,612,856 | B1 | 9/2003 | McCormack | |
| 6,623,307 | B2 * | 9/2003 | Korsunsky et al. | 439/676 |
| 6,709,295 | B2 * | 3/2004 | Givens et al. | 439/620.06 |
| 6,780,035 | B2 * | 8/2004 | Bohbot | 439/188 |
| 6,900,629 | B2 * | 5/2005 | Hwang et al. | 324/158.1 |

* cited by examiner

*Primary Examiner*—Neil Abrams
*Assistant Examiner*—Phuongchi Nguyen
(74) *Attorney, Agent, or Firm*—Wei Te Chung

(57) ABSTRACT

The present invention provides an electrical connector (100) defining a receptacle (200) for receiving a mating plug. The electrical connector (100) is mounted on a mother printed circuit board (10) and includes a number of conductive contacts (43) and a terminating device (45) for terminating said conductive contacts (43) when the plug and the electrical connector (100) are unmated. The terminating device (45) includes resistance elements (451) electrically connected between the conductive contacts (43) adjacent to each other so that the electrical connector (100) can absorb high frequency signals originating from active electronic circuitries of the mother printed circuit board (10).

10 Claims, 10 Drawing Sheets

ELECTRICAL CONNECTOR HAVING TERMINATING DEVICE

BACKGROUND OF THE INVENTION

1. Field of the Invention

The present invention relates to an electrical connector for mating with a plug, and more particularly, relates to an electrical connector having terminating device for terminating the electrical connector when the plug and the electrical connector are in unmated state.

2. Description of the Prior Art

A conventional electrical connector used to be mounted onto a printed circuit board having active electronic circuitries is disclosed in U.S. Pat. No. 6,780,035 issued on Mar. 12, 2002. An electrical jack is disclosed including a housing having an opening defined therein, through which a mating plug is received, a grounding strip, and at least one elastically deformable signal contact residing within the housing. As the mating plug is received, the elastically deformable signal contact moves from a position in contact with the grounding strip to a position not in contact with the grounding strip, thereby discharging static charge from the unshielded twisted pair cables and allowing normal connection to the mating plug. However, when the mating plug is not received in the opening, high frequency signals originating from the active electronic circuitries are shortened to ground and no energy is absorbed, as they are all reflected back into the electronic circuitries of the printed circuit board.

Hence, an improved electrical connector is needed to solve the above problem.

BRIEF SUMMARY OF THE INVENTION

One object of the present invention is to provide an electrical connector having a terminating device which can absorb high frequency signals originating from the active electronic circuitries.

The present invention provides an electrical connector mounted on an mother printed circuit board and defining a receptacle for receiving a mating plug. The electrical connector comprises a plurality conductive contacts and a terminating device for terminating said conductive contacts when the plug and the electrical connector are unmated, wherein the terminating device comprising resistance elements are serially connected between the conductive contacts adjacent to each other so that the electrical connector can absorbing high frequency signals originating from active electronic circuitries of the mother printed circuit board.

Other objects, advantages and novel features of the invention will become more apparent from the following detailed description of the present embodiments when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the Figures and in which:

DETAILED DESCRIPTION OF THE INVENTION

Figure 1:
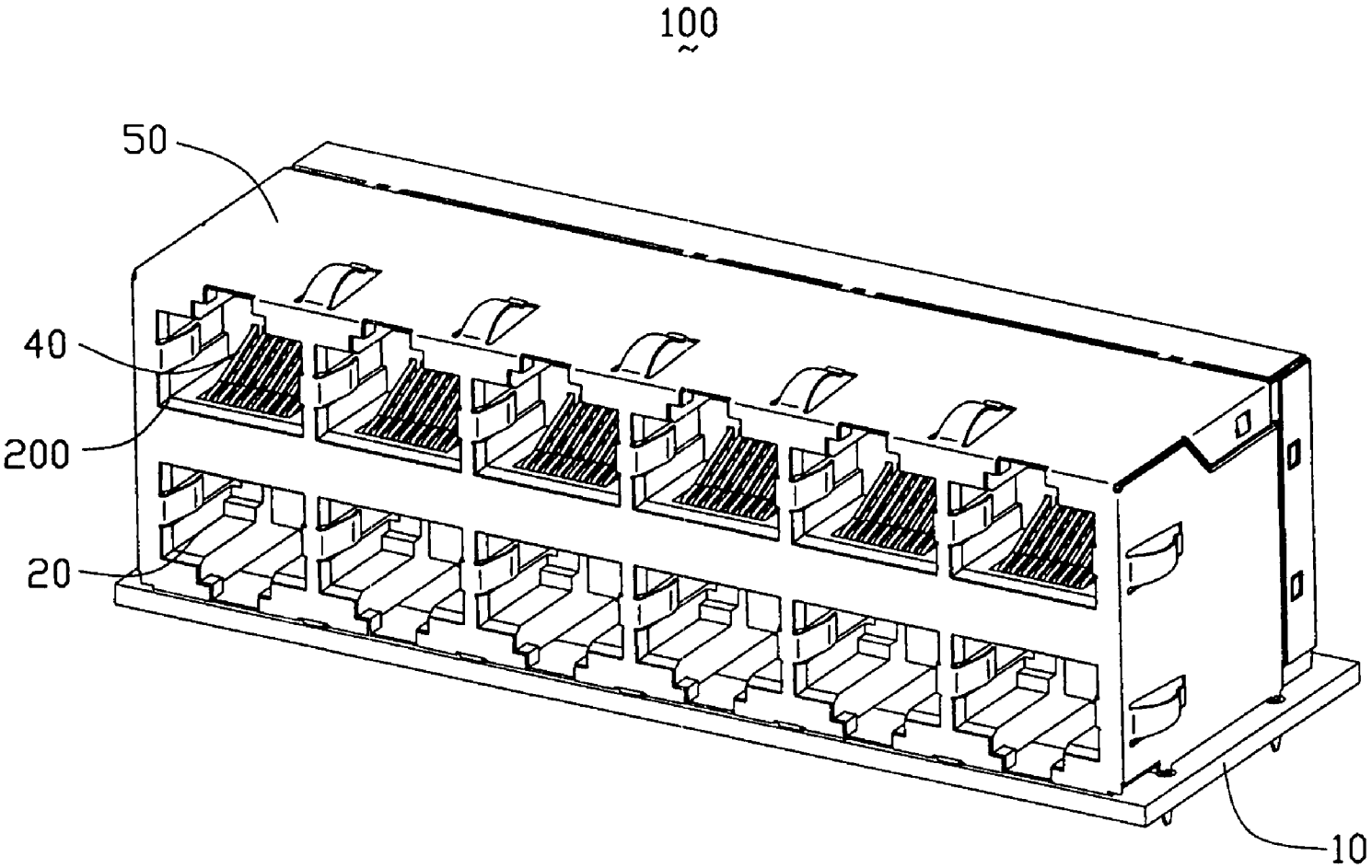
FIG. 1 is a perspective view of an electrical connector mounted on a mother printed circuit board in accordance with a first embodiment of the present invention.

Reference will now be made to the drawing Figures to describe the present invention in detail.

FIG. 1 shows an electrical connector 100 according to a first embodiment of the present invention. The electrical connector 100 is used to be mounted on a mother printed circuit board 10 and defines 2×6 ports 200 for mating with plugs (not shown). The electrical connector 100 comprises an insulative housing 20, a plurality of contact modules 40 received in said insulative housing 20 and a shield 50 covering the insulative housing 20.

Figure 2:
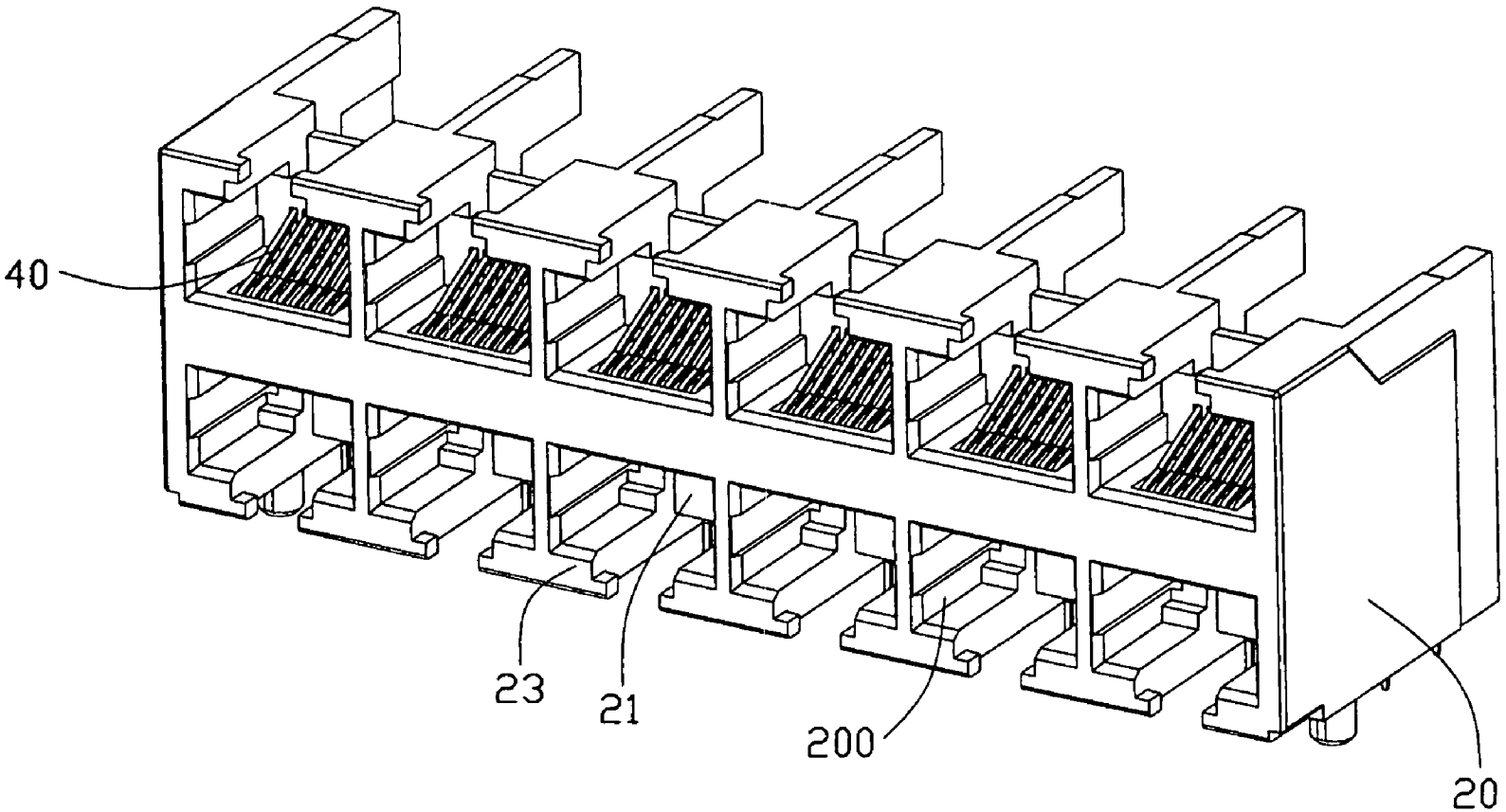
FIG. 2 is a perspective view of the electrical connector of FIG. 1 with a metal shield removed.

As shown in FIG. 2, the insulative housing 20 defines 2×6 receptacles 200 for mating with the plugs. Each of the receptacle 200 comprises a bottom wall 21 and four sidewalls 23 extending from said bottom wall 21 to define an inserting direction and an extracting direction along which the plug is inserted into and extracted from the receptacle 200.

Figure 3:
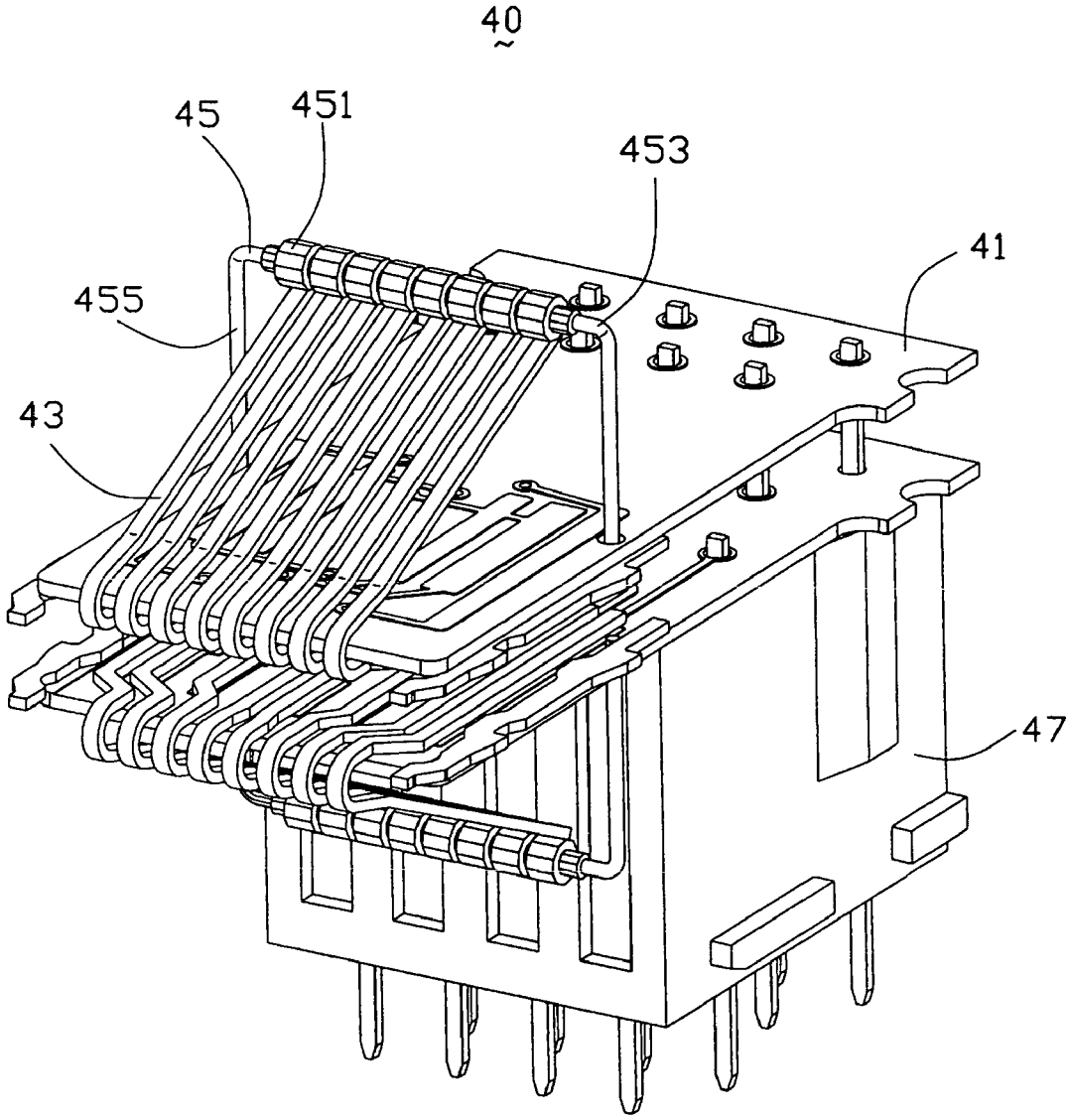
FIG. 3 is a perspective view of a contact module for the electrical connector of FIG. 1.
Figure 4:
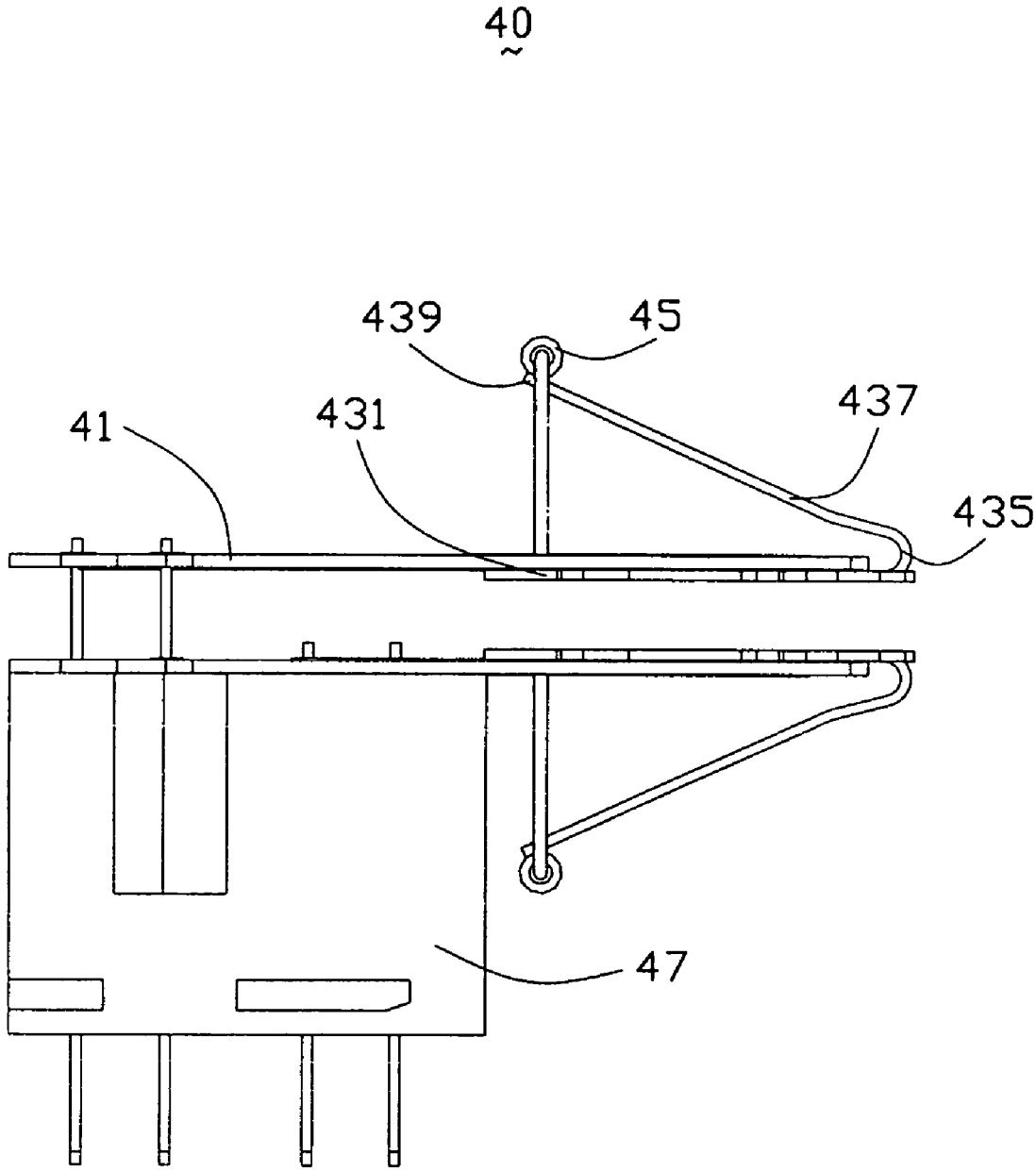
FIG. 4 is a side view of the contact module of FIG. 3.
Figure 5:
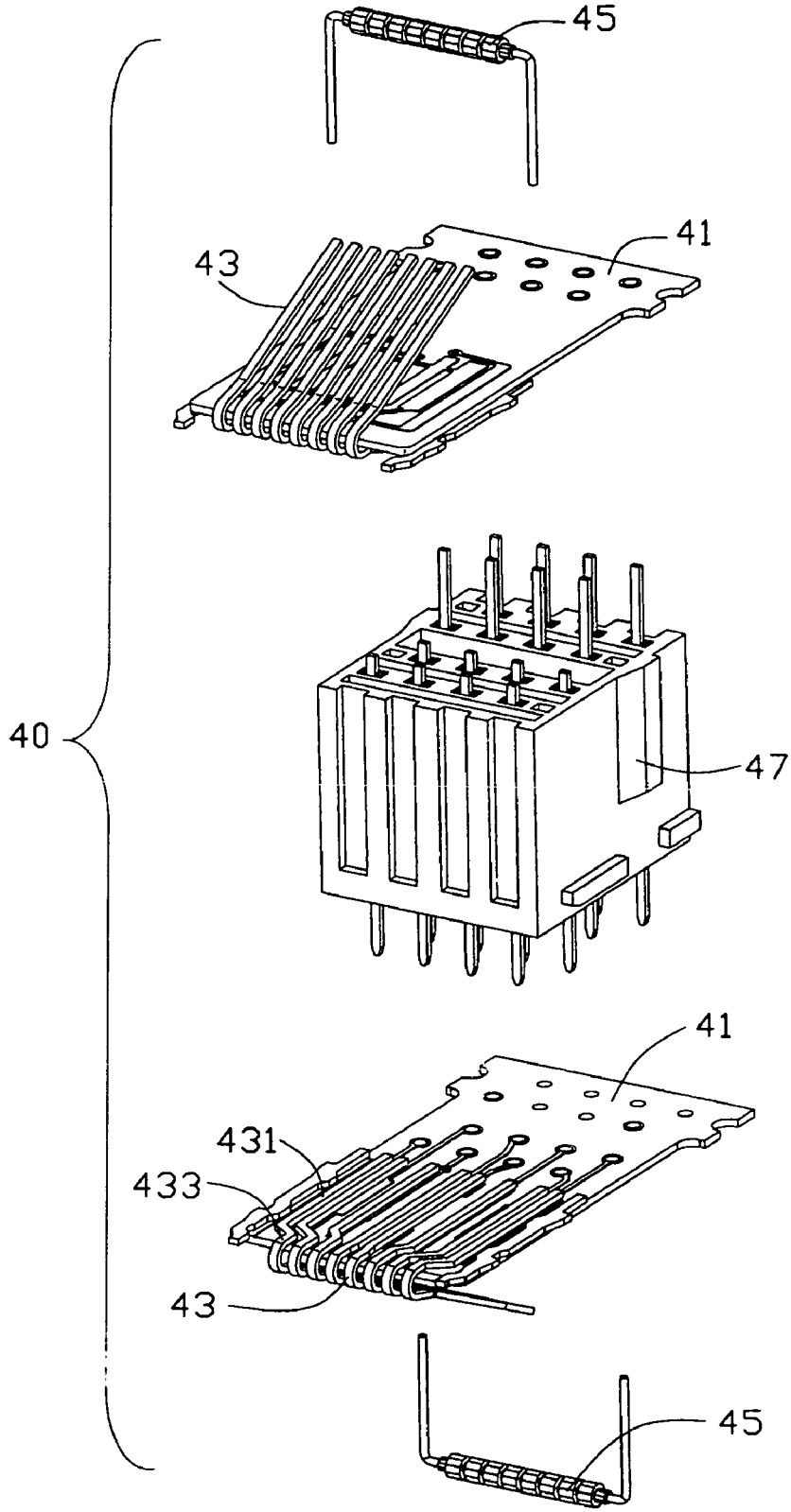
FIG. 5 is an exploded view of the contact module of FIG. 3.
Figure 6:
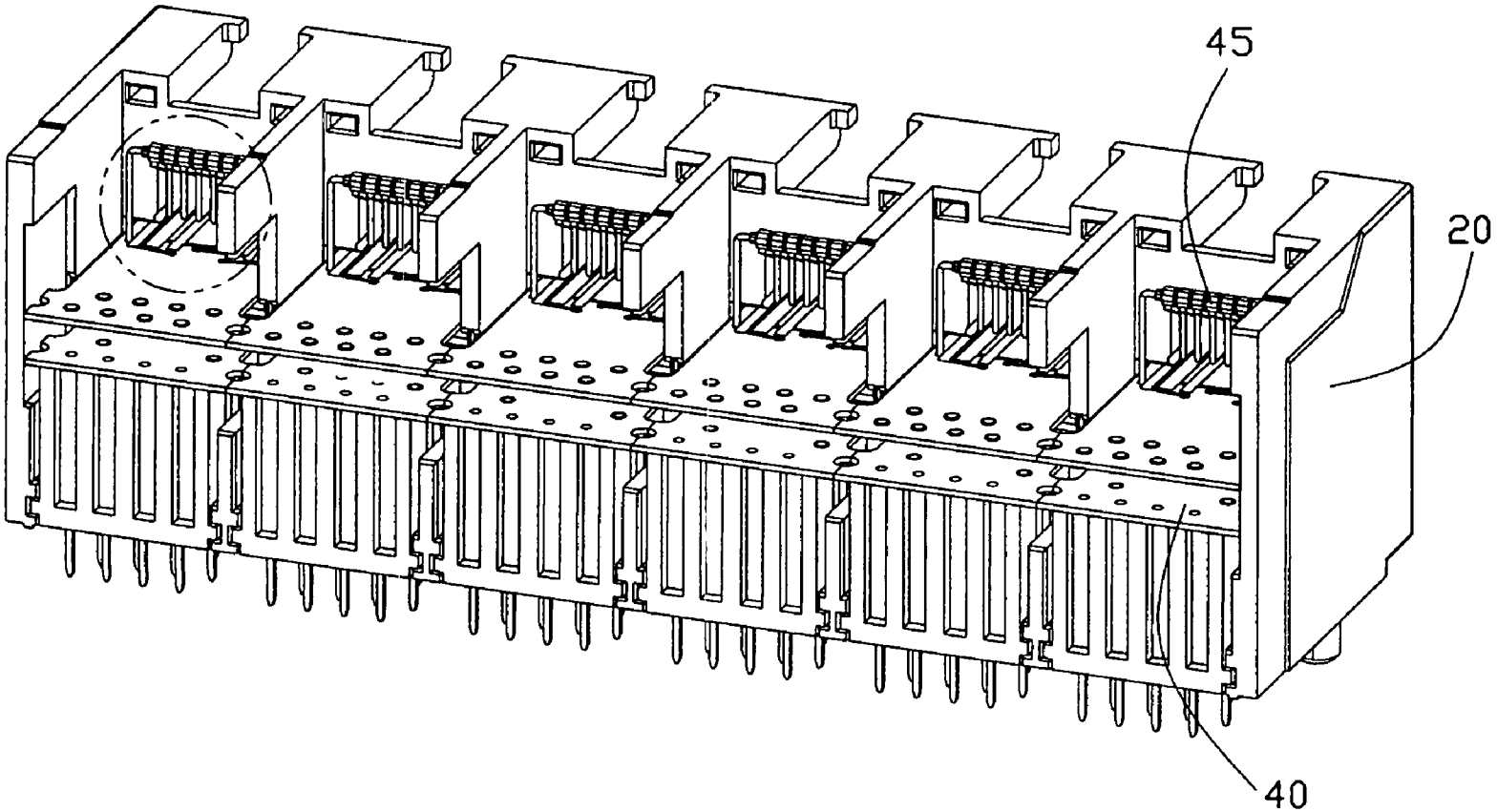
FIG. 6 is another perspective view of FIG. 2.
Figure 7:
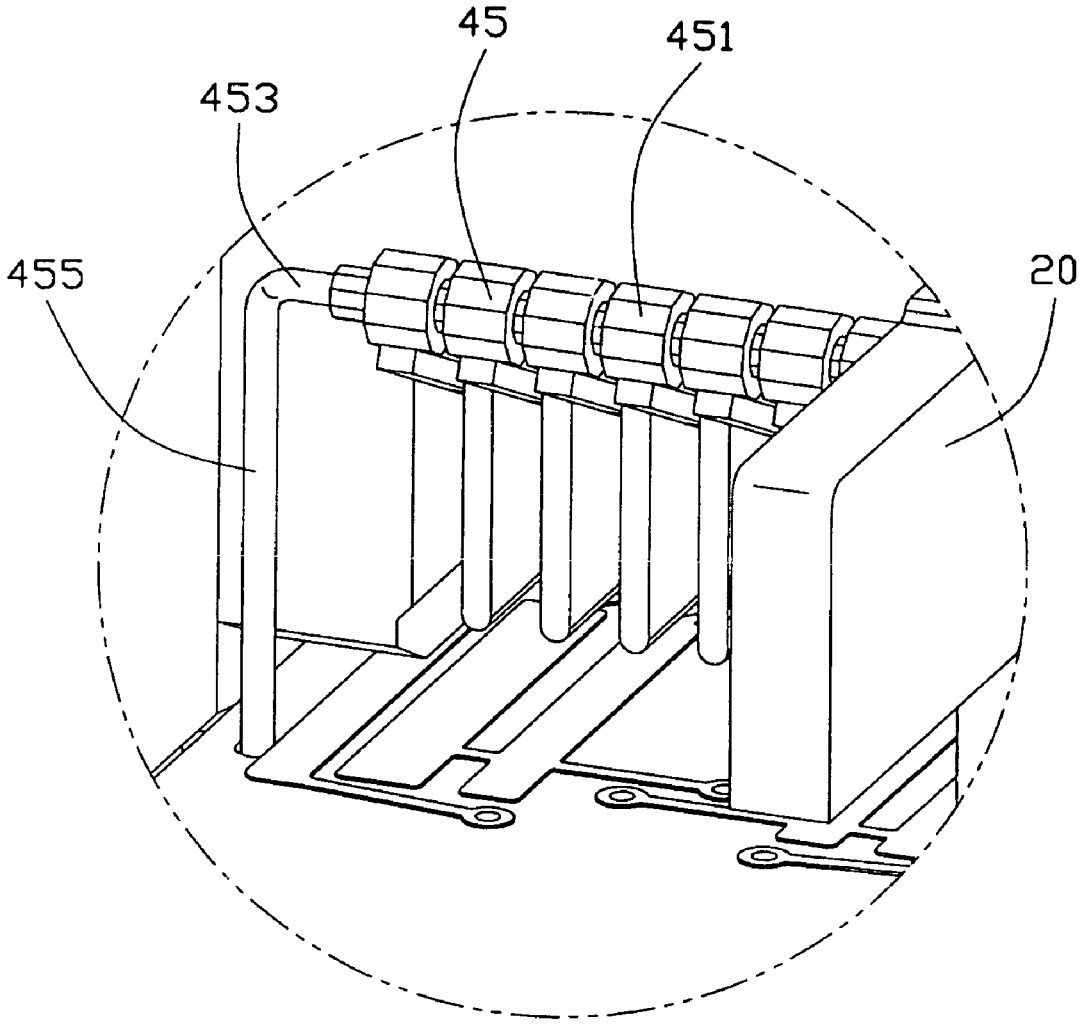
FIG. 7 is a partially scaled view of a circled portion of FIG. 6

As shown in FIGS. 3-5, the contact module 40 comprises a pair of daughter printed circuit boards 41 parallelly aligned to each other, two sets of conductive contacts 43 mounted onto each of the daughter printed circuit boards, two terminating devices 45 respectively soldered onto corresponding daughter printed circuit boards 41 and a box 47 having some electrical elements received therein and connecting the pair of daughter printed circuit boards 41 to the mother printed circuit board 10. Each of the conductive contacts 43 comprises a securing portion 431 soldered onto a bottom side of the daughter printed circuit board 41 and a floating cantilever forwardly connected to the securing portion 431. The floating cantilever further comprises a straight connecting portion 433, a flexible half-circled portion 435, a tangent contact portion 437 and a distal end 439 sequentially connected in a curve line. The terminating device 45 comprises a horizontal conductive bar 453, a number of cylinder resistance elements 451 sheathing the horizontal conductive bar 453 and a pair of erect posts 455 supporting two mutually opposite ends of the horizontal conductive bar 453. The pair of erect posts 455 are soldered onto the daughter printed circuit board 41 so that the resistance elements 451 are parallelly connected to ground. Furthermore, the resistance elements 451 are disposed corresponding to the conductive contacts 43 so that the distal ends 439 respectively flexibly abut the resistance elements 451.

When an electrical connector 100 according to the present invention is assembled, the contact modules 40 are inserted into the insulative housing 20 along the extracting direction with the daughter printed circuit board 41 mounted in the side walls 23 and the tangent contact portion 437 extending slantwise into the receptacle 200. In a state when the plug and the electrical connector 100 are unmated, the conductive contacts 43 respectively abut corresponding resistance elements 451 of the terminating device 45 so as to be serially electrically connected to the common conductive member 453 through the resistance elements 451, so that the electrical connector 100 can absorb high frequency signals originating from active electronic circuitries of the mother printed circuit board 10. By absorbing the steady state high frequency signals incident at the contact module 30 from the active circuitries, less crosstalk occurs, less emission occurs inside the box 47, and active PHY drivers have a stable characteristic impedance load when the plug is removed.

When the plug are partially inserted into the receptacle 200 and the plug firstly contacts the tangent contact portions 437 of the conductive contacts 43, the distal ends 439 of the conductive contacts 43 keep abutting the resistance elements 451 simultaneously so that the electronic static charged on the plug discharges through the conductive contacts 43 and the resistance elements 451 to ground. The tangent contact portion 437 is defined as a concave shape tangent to the flexible half-circled portion 435 for delaying the time of the distal ends 439 of the conductive contacts 43 getting away from the terminating device 45 when the plug is partially inserted into the receptacle 200 and contacts the tangent contact portion 435. When the plug and the electrical connector 100 are fully mated, said conductive contacts 43 switched from corresponding resistance elements 451 to the plug, so that the plug is electrically connected to the mother printed circuit board 10.

Figure 8:
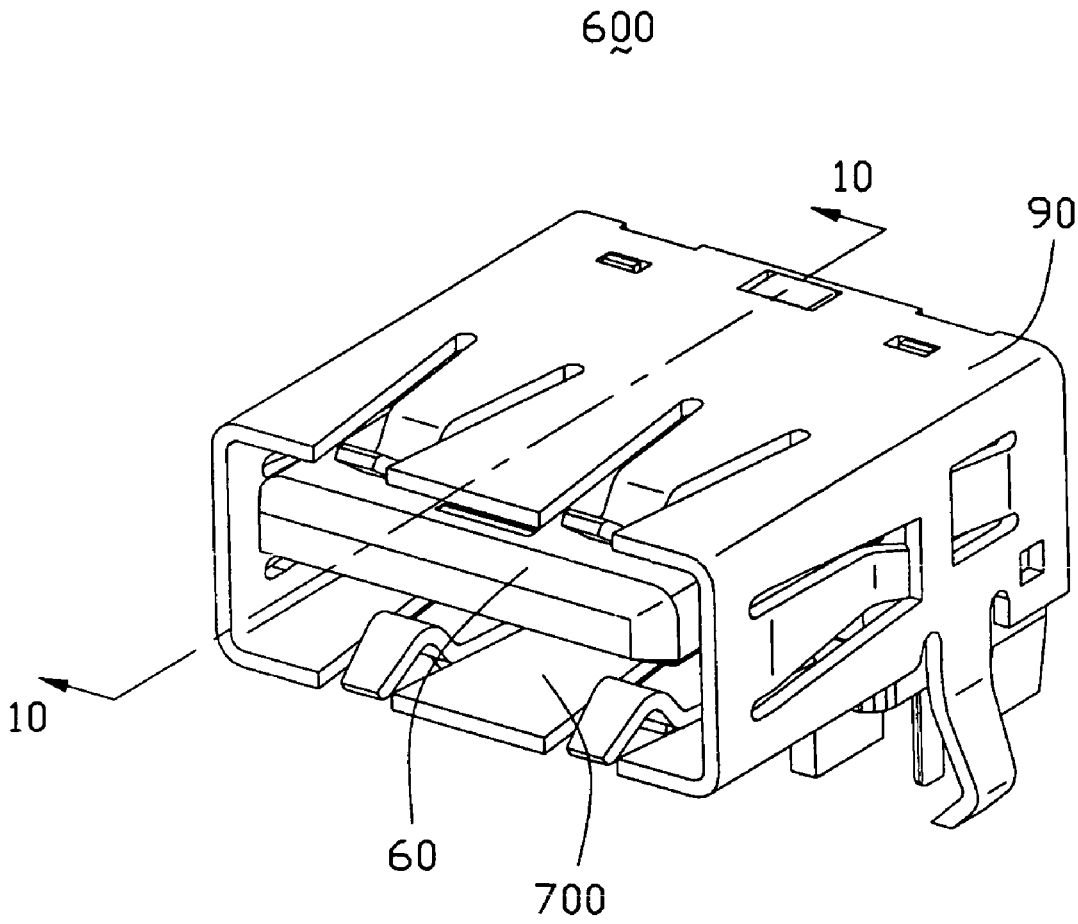
FIG. 8 is a perspective view of an electrical connector in accordance with a second embodiment of the present invention.
Figure 9:
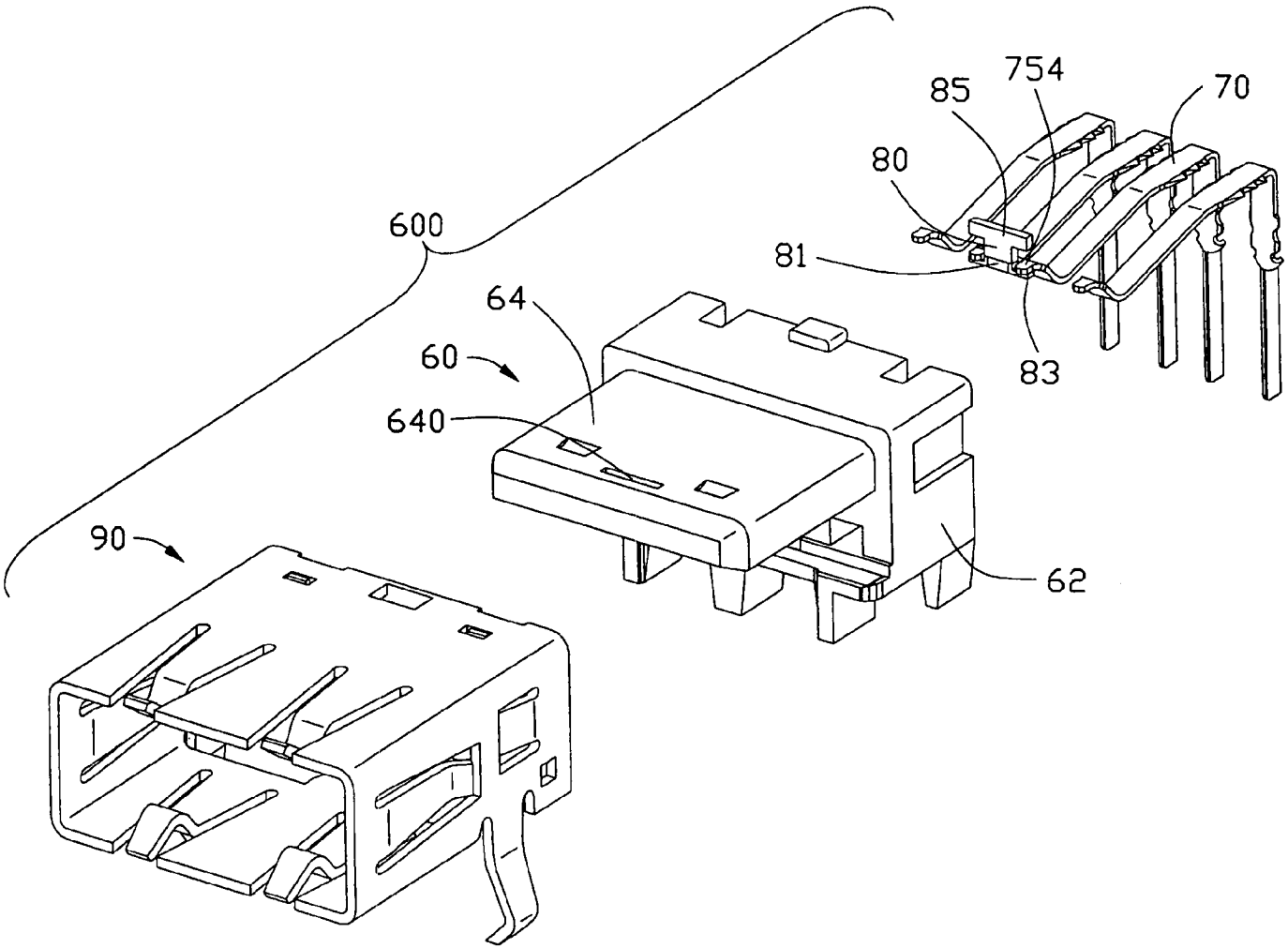
FIG. 9 is an exploded view of the electrical connector of FIG. 8.
Figure 10:
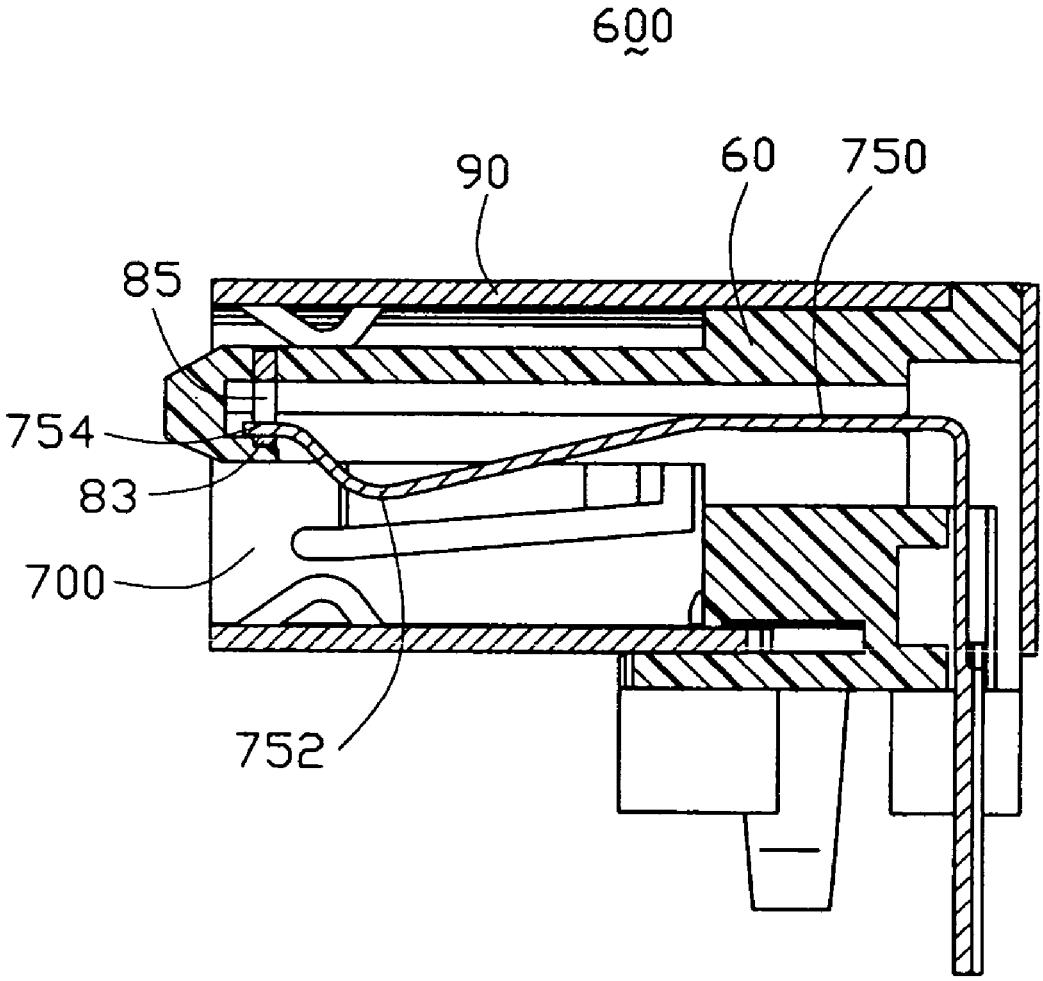
FIG. 10 is a sectional view of the electrical connector taken along a line 10-10 of FIG. 8.

Another electrical connector 600 according to a second embodiment of the present invention is disclosed in FIGS. 8-10. The electrical connector 600 is used to be mounted on a mother printed circuit board (not shown) and comprises an insulative housing 60, a plurality of conductive contacts 70 and a terminating device 80 received in the insulative housing 60, and a metal shield 90 overlaying said insulative housing 60. The insulative housing 60 and the shield 90 cooperatively define a receptacle 700 for a USB plug (not shown) to be inserted thereinto so an inserting direction and an extracting direction opposite to the inserting direction are defined.

The insulative housing 60 includes a base portion 62 and a tongue 64 extending along the extracting direction. Each of the conductive contacts 70 forms a securing portion 73 secured in the base portion 62 of the insulative housing 60, a floating cantilever extending from the securing portion 73 generally along the extracting direction. The floating cantilever further comprises a contact portion 752 extending from the securing portion 750 into the receptacle 700 and a distal end 754 extending slantwise into an end portion of the tongue 64. The terminating device 80 includes a resistance element 81, a pair of metal tabs 83 serially connecting to two opposite sides of the resistance element 81 and a cap portion 85 for securing the terminating device 80 to the insulative housing 60. The terminating device 80 is mounted into a slot 640 defined in the tongue 64 of the insulative housing 60 with the pair of tabs 83 respectively abutting the distal ends of two conductive contacts 70 when the USB plug and the electrical connector 600 are unmated. The electrical connector 600 can achieve the similar function in the same way as described in the above first embodiment of the present invention.

In the above two embodiments, the terminating device includes only pure resistance elements of 50 ohms which are the perfect terminations when the characteristic impedances of the active circuitries are pure resistances of 50 ohms. However, when the characteristic impedances of the active circuitries are complex impedances, the terminating device may include some complex load terminations accordingly.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

We claim:

1. An electrical connector mounted on a printed circuit board and defining a receptacle for receiving a mating plug, said electrical connector comprising:

a plurality of conductive contacts electrically connecting to said printed circuit board and comprising a contact portion extending into said receptacle for mating with said plug;

a terminating device comprising a plurality of impedance elements for respectively electrically connecting to corresponding conductive contacts and absorbing high frequency signals originating from active electronic circuitries of said printed circuit board when said plug and the electrical connector are unmated;

wherein the terminating device further comprises a common conductive member, said impedance elements electrically connecting corresponding contacts to said common conductive member;

wherein said common conductive member connects to ground, and wherein when said plug is partially inserted into the receptacle, and the plug contacts the conductive contacts with the conductive contacts remaining connected to said impedance elements so that the electronic static charge on the plug is discharged;

wherein each of said conductive contacts comprises a securing portion for securing the conductive contact in the receptacle, a floating cantilever extending from the securing portion, said floating cantilever comprising said contact portion and a distal end extending from said contact portion, and wherein said terminating device abuts said conductive contacts on said distal ends;

wherein said securing portions are soldered onto a daughter printed circuit board, said daughter printed circuit board being mounted in a side wall of said receptacle parallel to an inserting direction of the plug.

2. The electrical connector according to claim 1, wherein said contact portion comprises an arcuate portion with an end tangent to an inserting direction of the plug and extending slantwise along said insertion direction.

3. The electrical connector according to claim 1, wherein the floating cantilever comprises a flexible half-circled portion connecting to the contact portion and a straight connecting portion in an inserting direction of the plug, said straight connecting portion further connecting to securing portion in said inserting direction.

4. The electrical connector according to claim 1, said termination device defines a horizontal bar, and said impedance elements are of a tubular form commonly enclosing said horizontal bar and directly engaging the contacting portions of the corresponding contacts, respectively.

5. The electrical connector according to claim 1, wherein engagement between the contacting portion and the corresponding impedance element is performed with a circumference defined by the impedance element and a tangent line defined by the contacting portion.

6. The electrical connector according to claim 1, the contacting portion of one contact engages one lateral side portion of the corresponding impedance element.

7. The electrical connector according to claim 1, wherein the contacting portion of the contact directly mechanically engages the corresponding impedance element.

8. The electrical connector according to claim 1, wherein said common conductive member comprises a horizontal metal bar electrically connecting to said impedance elements.

9. The electrical connector according to claim 8, wherein said common conductive member further comprises a pair of erect metal post connecting said horizontal metal bar to said daughter printed circuit board.

10. The electrical connector according to claim 8, wherein said impedance elements are pure resistance elements of desired termination impedance.

* * * * *